US010333225B1

(12) United States Patent
Kanagasabai et al.

(10) Patent No.: US 10,333,225 B1
(45) Date of Patent: Jun. 25, 2019

(54) MULTIBAND RECONFIGURABLE MICROWAVE FILTENNA

(71) Applicants: Malathi Kanagasabai, Chennai (IN); Thipparaju Rama Rao, Nellore (IN); Sandeep Kumar Palaniswamy, Chennai (IN); Saffrine Kingsly, Chennai (IN); Mohammed Gulam Nabi Alsath, Chennai (IN); Deepa Thangarasu, Tindivanam (IN); Padmathilagam Sambandam, Cuddalore (IN); Sangeetha Subbaraj, Chennai (IN); Yogeshwari Panneer Selvam, Thanjavur (IN)

(72) Inventors: Malathi Kanagasabai, Chennai (IN); Thipparaju Rama Rao, Nellore (IN); Sandeep Kumar Palaniswamy, Chennai (IN); Saffrine Kingsly, Chennai (IN); Mohammed Gulam Nabi Alsath, Chennai (IN); Deepa Thangarasu, Tindivanam (IN); Padmathilagam Sambandam, Cuddalore (IN); Sangeetha Subbaraj, Chennai (IN); Yogeshwari Panneer Selvam, Thanjavur (IN)

( * ) Notice: Subject to any disclaimer, the term of this patent is extended or adjusted under 35 U.S.C. 154(b) by 0 days.

(21) Appl. No.: 15/904,323

(22) Filed: Feb. 24, 2018

(51) Int. Cl.

| | |
|---|---|
| ***H01P 7/08*** | (2006.01) |
| ***H01Q 1/24*** | (2006.01) |
| ***H01Q 9/04*** | (2006.01) |
| ***H01Q 9/40*** | (2006.01) |
| ***H01P 1/203*** | (2006.01) |
| ***H01Q 13/08*** | (2006.01) |

(52) U.S. Cl.
CPC ..... *H01Q 9/40* (2013.01); *H01P 1/203* (2013.01); *H01P 7/082* (2013.01); *H01Q 1/24* (2013.01); *H01Q 9/045* (2013.01); *H01Q 13/085* (2013.01)

(58) Field of Classification Search
None
See application file for complete search history.

(56) References Cited

U.S. PATENT DOCUMENTS

2009/0160582 A1* 6/2009 Fukamachi ..... H01P 1/20381 333/204
2017/0256854 A1* 9/2017 Hu ..... H01Q 1/243

* cited by examiner

*Primary Examiner* — Howard Williams

(57) ABSTRACT

The embodiments herein provide a multiband reconfigurable filtenna comprising a monopole antenna coupled to a center split transmission line and a reconfigurable microstrip filter replacing a feed-in end of the center split transmission line to provide resonance to the monopole antenna at a plurality of frequency bands. The reconfigurable microstrip filter includes a C-shaped resonator (CSR), a meandered loop resonator (MLR), an Inverted Pulse Shaped Resonator (IPSR) and an Open Circuited Stub (OCS). Further, a plurality of switches is coupled to the reconfigurable microstrip filter to switch coupling of the monopole antenna between the CSR, the MLR, the IPSR and the OCS for operating the monopole antenna, at one of the plurality of frequency bands.

12 Claims, 2 Drawing Sheets

MULTIBAND RECONFIGURABLE MICROWAVE FILTENNA

TECHNICAL FIELD

The present invention is generally related to a field of microwave communication. The present invention is particularly related monopole antennas used for microwave communication. More particularly the present invention relates to reconfigurable multiband antenna systems used in microwave communication.

BACKGROUND OF THE INVENTION

The field of wireless communications has seen a significant growth in the communication standards and protocols used for audio, video and data communication. Mobile devices incorporate antenna systems that are adaptable to the various communication standards and protocols. The various communication standards and protocols typically exist over a broad frequency spectrum such as 1.8 Gigahertz (GHz) for Global System for Mobile Communications (GSM), 2.5 GHz for Bluetooth™, 3.5 GHz for Worldwide Interoperability for Microwave Access (WiMax) and 5.2 GHz for Wireless Local Area Network (WLAN) technologies. As a result, the antenna systems need to support signals of the various frequency bands for effective communication. A key to effective communication is to design a filtenna design coupled to the antenna system that filters out out-band interferences and noises present in a wideband spectrum.

Existing methods for filtering out out-band interferences and noises involve using a band stop filter that suppresses undesired frequency signals. Several techniques and structures such as cavity filters, dielectric body embodiments, surface integrated waveguides, high impedance surface, frequency selective surfaces have been used to suppress undesired signals reaching an antenna system. Some techniques involve use of large number of diodes and radio frequency (RF) Micro-Electro-Mechanical Systems (MEMS) switches for achieving frequency selectivity and spectral efficiency. However aforementioned structures are typically complex in design and include complex biasing mechanisms and increase an overall cost of the antenna systems. Further, frequency selectivity by existing filtering techniques achieved only for higher frequencies. Furthermore, some techniques in the field of cognitive radio applications involve use of separate modules are integrated in a single substrate for spectrum sensing and to communicate with RF bands. However such integration leads to large volume and bulky structures.

Hence, there is a need for a multi band reconfigurable filtenna design of less complexity to filter out band interferences. Also there is a need for a filtenna design that provides high spectral efficiency and frequency selectivity. Hence an alternative and economical multi band reconfigurable filtenna design for antenna systems is proposed.

OBJECTIVES OF THE INVENTION

The primary objective of the present invention is to provide a multiband reconfigurable monopole antenna system.

Yet another objective of the present invention is to provide a multi band reconfigurable microstrip filter that can be discretely tuned to a plurality of frequency bands and that is compatible with the multi band reconfigurable monopole antenna system.

Yet another objective of the present invention is to couple the multiband reconfigurable microstrip filter into a vertical feed of the antenna system.

Yet another objective of the present invention is to design a compact sized multiband reconfigurable antenna system.

These and other objects and advantages of the present invention will become readily apparent from the following detailed description taken in conjunction with the accompanying drawings.

SUMMARY OF THE INVENTION

The various embodiments of the present invention provide a multiband reconfigurable filtenna to resonate at a plurality of frequency bands with minimum interference between the plurality of frequency bands. The embodiments of the present invention provide a multiband reconfigurable filtenna comprising a monopole antenna coupled to a center split transmission line and a reconfigurable microstrip filter replacing a feed-in end of the center split transmission line to provide resonance to the monopole antenna at the plurality of frequency bands. According to an embodiment, the reconfigurable microstrip filter, includes a C-shaped resonator (CSR), coupled at a first predefined position to the center split transmission line and configured to provide a resonance to the monopole antenna at a first frequency band.

According to an embodiment, the reconfigurable microstrip filter includes, a meandered loop resonator (MLR), coupled at a second predefined position to the center split transmission line and configured to provide a resonance to the monopole antenna at a second frequency band.

According to an embodiment, the reconfigurable microstrip filter includes, an Inverted Pulse Shaped Resonator (IPSR) coupled at a second predefined position to the center split transmission line and configured to provide a resonance to the monopole antenna at a second frequency band.

According to an embodiment, the reconfigurable microstrip filter includes, an Open Circuited Stub (CCS) coupled at a fourth predefined position to the center split transmission line and configured to provide a resonance to the monopole antenna at a fourth frequency band.

According to an embodiment, the multiband reconfigurable filtenna includes, a plurality of switches coupled to the reconfigurable microstrip filter configured to switch coupling of the monopole antenna between the CSR, the MLR, the IPSR and the OCS for operating the monopole antenna at one of the first frequency band, the second frequency band, the third frequency band and the fourth frequency band respectively.

According to an embodiment, the multiband reconfigurable filtenna includes, a bandstop filter coupled to the reconfigurable microstrip to provide interference cancellation between the plurality of frequency bands.

According to an embodiment of the multiband reconfigurable filtenna, the first frequency band is based on a physical length of the CSR, and wherein the physical length of the CSR is alterable.

According to an embodiment of the multiband reconfigurable filtenna, the second frequency band is based on a circumferential length of a loop comprising the MLR, and wherein the circumferential length of the loop is alterable.

According to an embodiment of the multiband reconfigurable filtenna, the third frequency band is based on physical length of the IPSR, and wherein the physical length of the IPSR is alterable.

According to an embodiment of the multiband reconfigurable filtenna, the fourth frequency band is based on a physical length of the OCS, and wherein the physical length of the OCS is alterable.

According to an embodiment of the multiband reconfigurable filtenna, wherein the first frequency band is a Global System for Mobile Communications (GSM) band of 1.8 Gigahertz, the second frequency band is a Worldwide Interoperability for Microwave Access (WiMax) frequency band of 3.5 Gigahertz, the third frequency baud is a Bluetooth frequency band of 2.4 Gigahertz and the fourth frequency band is a Wireless Local Area Network (WLAN) frequency band of 5.2 Gigahertz.

According to an embodiment of the multiband reconfigurable filtenna, the first predefined position comprises a lateral side of the center split transmission line, the second predefined position comprises an area enclosed by the CSR, the third predefined position comprises another lateral side symmetrically opposite to the lateral side of the center split transmission line, and the fourth predefined position comprises an area enclosed by the IPSR.

According to an embodiment of the multiband reconfigurable filtenna, the plurality of switches comprises a plurality of PIN diodes operated to be at least one of open and short based on control signals provided by a biasing circuit, and couple or decouple one of CSK, MLR , IPSR and OCS to the monopole antenna respectively.

According to an embodiment of the multiband reconfigurable filtenna, the feed-in end of the center split transmission line replaced by the reconfigurable microstrip filter bears a resistance of fifty ohms.

According to as embodiment of the multiband reconfigurable filtenna, the center split transmission line is an electrical transmission line split at the center configured to carry electrical signals to the monopole antenna.

According to an embodiment, the multiband reconfigurable filtenna includes, a perturbed rectangular slot, etched in a ground of the reconfigurable microstrip filter, and configured to increase a bandwidth of the plurality of frequency bands.

These and other aspects of the embodiments herein will he better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
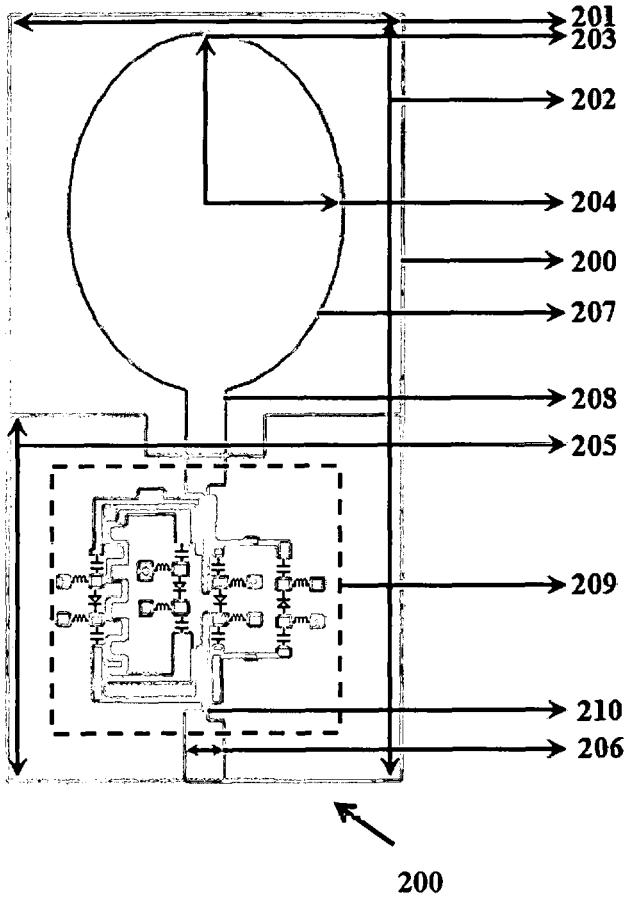
FIG. 1 illustrates a multiband reconfigurable filtenna, according to one embodiment of the present invention.

Although the specific features of the present invention are shown in some drawings and not in others. This is done for convenience only as each feature may be combined with any or ail of the other features in accordance with the present invention.

DETAILED DESCRIPTION OF THE INVENTION

In the following detailed description, reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments of the present invention provide a multiband reconfigurable filtenna to resonate at a plurality of frequency bands with minimum interference between the plurality of frequency bands. The embodiments of the present invention provide a multiband reconfigurable filtenna comprising a monopole antenna coupled to a center split transmission line and a reconfigurable microstrip filter replacing a feed-in end of the center split transmission line to provide resonance to the monopole antenna at the plurality of frequency bands. According to an embodiment the reconfigurable microstrip filter, includes a C-shaped resonator (CSR), coaled at a first predefined position to the center split transmission line and configured to provide a resonance to the monopole antenna at a first frequency band.

According to an embodiment, the reconfigurable microstrip filter includes, a meandered loop resonator (MLR), coupled at a second predefined position to the center spilt transmission line and configured to provide a resonance to the monopole antenna at a second frequency band.

According to an embodiment, the reconfigurable microstrip filter includes, an Inverted Pulse Shaped Resonator (IPSR) coupled at a second predefined position to the center split transmission line and configured to provide a resonance to the monopole antenna at a second frequency band.

According to an embodiment, the reconfigurable microstrip filter includes, an Open Circuited Stub (OCS) coupled at a fourth predefined position to the center split transmission line and configured to provide a resonance to the monopole antenna at a fourth frequency band.

According to an embodiment, the multiband reconfigurable filtenna includes, a plurality of switches coupled to the reconfigurable microstrip filter configured to switch coupling of the monopole antenna, between the CSR, the MLR, the IPSR and the OCS for operating the monopole antenna at one of the first frequency band, the second frequency band, the third frequency band and the fourth frequency band respectively.

According to an embodiment, the multiband reconfigurable filtenna includes, a bandstop filter coupled to the reconfigurable microstrip to provide interference cancellation between the plurality of frequency bands.

According to an embodiment of the multiband reconfigurable filtenna, the first frequency band is based on a physical length of the CSR, and wherein the physical length of the CSR is alterable.

According to an embodiment of the multiband reconfigurable filtenna, the second frequency band is based on a circumferential length of a loop comprising the MLR, and wherein die circumferential length of the loop is alterable.

According to an embodiment of the multiband reconfigurable filtenna, the third frequency band is based on a physical length of the IPSR, and wherein the physical length of the IPSR is alterable.

According to an embodiment of the multiband reconfigurable filtenna, the fourth frequency band is based on a physical length of the OCS, and wherein the physical length of the OCS is alterable.

According to an embodiment of the multiband reconfigurable filtenna, the first frequency band is a Global System for Mobile Communications (GSM) band of 1.8 Gigahertz, the second-frequency band is a Worldwide interoperability for Microwave Access (WiMax) frequency band of 3.5 Gigahertz, the third frequency band is a Bluetooth frequency band of 2.4 Gigahertz and the fourth frequency band is a Wireless Local Area Network (WLAN) frequency band of 5.2 Gigahertz.

According to an embodiment of the multiband reconfigurable filtenna, the first predefined position comprises a lateral side of the center split transmission line, the second predefined position comprises an area enclosed by the CSR, the third predefined position comprises another lateral side symmetrically opposite to the lateral side of the center split transmission line, and the fourth predefined position comprises an area enclosed by the IPSR.

According to an embodiment of the multiband reconfigurable filtenna, the plurality of switches comprises a plurality of PIN diodes operated to be at least one of open and short based on control signals provided by a biasing circuit, and couple or decouple one of CSR, MLR, IPSR and OCS to the monopole antenna respectively.

According to an embodiment of the multiband reconfigurable filtenna, the feed-in of the center split transmission line replaced by the reconfigurable microstrip filter bears a resistance of fifty ohms.

According to an embodiment of the multiband reconfigurable filtenna, the center split transmission line is an electrical transmission line split at the center configured to carry electrical signals to the monopole antenna.

According to an embodiment, the multiband reconfigurable filtenna includes, a perturbed rectangular slot, etched in a ground of the reconfigurable microstrip filter, and configured to increase a bandwidth of the plurality of frequency bands.

FIG. 1 illustrates a multiband reconfigurable filtenna 200, according to one embodiment of the present invention. The filtenna includes an elliptical radiator 207 referred to hereinafter as a monopole antenna 207, a center split transmission line 210, a feedline 208 referred to hereinafter as a feed-in end 208 of the center split transmission line 210 and a reconfigurable microstrip filter 209. Typically a width of the filtenna 201 and a length of the filtenna 202 is designed to match a required radiation characteristics. In an embodiment, the monopole antenna 207 can have a width 201 of 1.6 mm and a relative permittivity (εr) of 4.3 with a tangent loss 0.025.

The monopole antenna 207 is coupled to the center split transmission line 210 at tbs feed-in end 208. The reconfigurable microstrip filter 209 replaces a portion of the feed-in end 208 as show in FIG. 1 to control the resonance characteristics of the monopole antenna 207 and filter out-band interferences. In an embodiment the microstrip filter 209 may be printed on a FR4 substrate. A sufficient length 205 and width 206 of the feed-in end 208 is provided to accommodate the reconfigurable microstrip filter 209. In an embodiment, resistance of fifty ohms of the feed-in end 208 is replaced by the reconfigurable microstrip filter 209. A perturbed rectangular slot is cut on the ground plane to increase the impedance bandwidth of the monopole antenna 207. Primarily the pertutbed rectangular slot is introduced in the middle of the microstrip filter 209 of the center strip transmission line 210 to achieve band stop characteristics. An impedance of the transmission line 210 is altered to achieve active power transfer between a plurality of resonators of the microstrip filter 209 and the transmission line 210. Altering the impedance for active power transfer and filtering characteristics of the microstrip filter 209 is explained in reference to FIG. 2.

Figure 2:
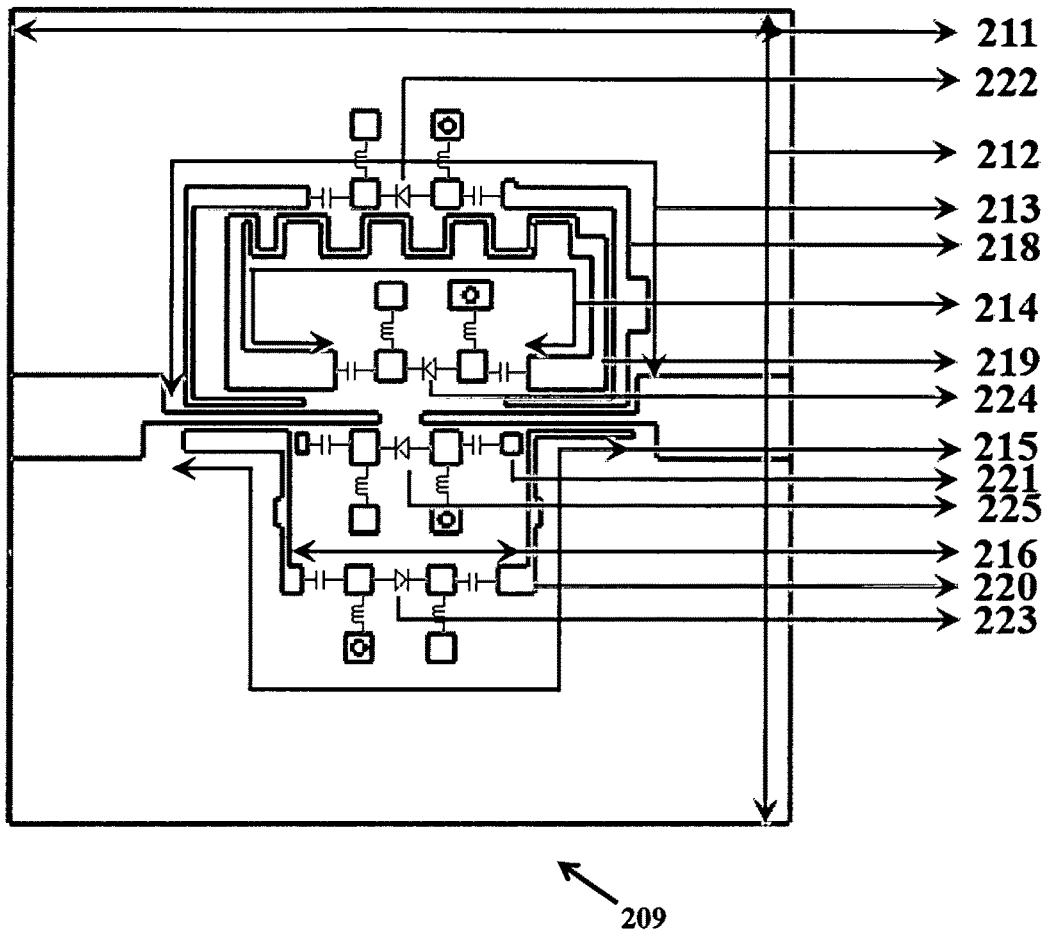
FIG. 2 illustrates a reconfigurable microstrip filter of the multiband reconfigurable filtenna of FIG. 1, according to m embodiment of the present invention.

FIG. 2 illustrates the reconfigurafele microstrip filter 209 of the multiband reconfigurable filtenna 200 of FIG. 1, according to an embodiment of the present invention. Use microstrip fiber 209 is typically a bandpass or bandstop filters that brings in a filtering property of the filtenna 200 in the antenna 207 itself. This can be done by integrating the microstrip filter 209 in the feed-in end 208 of the monopole antenna 207 as a single module without increasing a complexity of a receiver that incorporates the filtenna 200. The filtering properties is interspersed with the feed-in end 208 of the monopole antenna 207 hence does not affect the radiation properties of the monopole antenna 207. The incorporated microstrip filter 209 enables the monopole antenna 207 to discriminate desired signals from wideband noise signals by rejecting unwanted signals. By increasing an order of the microstrip filter 209 without increasing the complexity of the receiver, an increased in spectral efficiency, frequency selectivity and receiver sensitivity is achievable. Using muitiband configurable filtenna 200 it is possible to discriminate the desired signals according to die user demand by proficiently mitigating the undesirable signals.

The microstrip filter 209 includes a C-Shaped Resonator (CSR) 218, a Meandered Loop Resonator (MLR) 219, an Inverted Pulse Shaped Resonator (IPSR) 220, an Open Circuited Stub (OCS) 221 and a plurality of PIN diodes such a PIN $diode_1$ 222, PIN $diode_2$ 223, PIN $diode_3$ 224, and PIN $diode_4$ 225. Aforementioned four distinct resonators viz the C-Shaped Resonator (CSR) 218, the Inverted Pulse Shaped Resonator (IPSR) 220, the Meandered Loop Resonator (MLR) 219 and the Open Circuited Stub (OCS) 221 with four PIN diodes 222-225 are capable of covering a spectrum of 1.6 GHz to 5.5 GHz. Alternatively, the four resonators are capable of operating the filtenna 200 for Global System for Mobile (GSM), BLUETOOTH, Worldwide Interoperability for Microwave Access (WIMAX) and Wireless local Area Network (WLAN).

The CSR 218 coupled at a first predefined position to the center split transmission line 210 and configured to provide a resonance to the monopole antenna 207 at a first frequency band viz the GSM frequency band, which is 1.8 GHz. A length of the CSR 213 is alterable on the basis of a fundamental wavelength mode of excitation. As a result, the first frequency band is based on the length 213.

Further, the meandered loop resonator (MLR) 219 is coupled at a second predefined position to the center split transmission line 210 and is configured to provide a resonance to the monopoly antenna 207 at a second frequency band which is the WiMax band of 3.5 GHz. In an embodiment, the second frequency band is based on a length of the MLR 214, which is a circumferential length of a loop comprising the MLR 219. The circumferential length of the loop is alterable and to die fundamental wavelength of corresponding frequency band viz WiMax band. The energy coupling to the MLR 219 takes place through CSR 218 due to the positioning of the MLR 219 and the CSR 218 around the transmission line 210 As shown the first predefined position comprises a lateral side of the center spdt transmission line 210, and the second predefined position comprises an area enclosed by the CSR 218.

Further, the Inverted pulse shaped resonator (IPSR) 220 is coupled at a third predefined position to the center spilt transmission line 210 and is configured to provide a resonance to the monopole antenna 207 at a third frequency band which is Bluetooth™ frequency band of 2.4 GHz. Further, the third frequency band is based on a length of the IPSR 215. By altering the length or physical length of the IPSR 215 that is etched into a substrate of the microstrip filter 209, the frequency band of resonance for the IPSR 220 can be modified.

Furthermore, the Open Circuited Stub (DCS) 221 is coupled at a fourth predefined position, to the center split transmission line tip and configured to provide a resonance to the monopole antenna 207 at a fourth frequency band which is the WLAN frequency band of 5.2 GHz. The fourth frequency band is based on a length of the OCS 216, where the physical length of the OCS 221 is alterable. In an embodiment, a length of the OCS 216 corresponds to a quarter wavelength mode of excitation. Further, the third predefined position comprises another lateral side symmetrically opposite to the lateral side of the center split transmission line 210, and the fourth predefined position comprises an area enclosed by the IPSR 220.

The frequeney selectivity is controlled using four PIN diodes 222-225 with simple DC biasing. The PIN diodes 222-225 are deployed in suitable position of the four resonators and are switched ON and OFF that couple respective resonator to the monopole antenna 207 and thereby attain a multi band configurable antenna system. The plurality of PIN diodes 222-225 act as a plurality of switches that can be in an open or a short state based on control signals provided by a biasing circuit. Accordingly, the PIN diodes 222-225 may couple or decouple one of the CSR 238, the MLR 219, the IPSR 220 and the OCS 221 to the monopole antenna 207 respectively.

Disclosed filtenna 200 can operate in single band, dual band, tri band and quad band state according to the user using the PIN diodes 222-225. Disclosed design concept is verified and tested by integrating the microstrip filter 209 with the feed of the antenna 207. Upon testing a maximum gain of 1.1 dBi for GSM, 2.6 dBi for BLUETOOTH, 3 dBi for WIMAX and 3.4 dBi for WLAN is attained.

As a result the filtenna 200 performs independent switching between four desired operatic bands with fine selectivity and hence suitable for cognitive radio applications. The filtenna 200 proficiently radiates only at desired bands with the reflection coefficient above −20 dB and highly mitigates the effect of out of band interferences. The filtenna 200 offers omnidirectional pattern with flat group delay, which leads to less distortion.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modiftcafions should and are intended to be comprehended within the meaning and range of equivalents of the disclosed embodiments.

It is to be understood that the phraseology or terminology employed hereto is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the embodiments herein with modifications. Although toe embodiments herein are described with various specific embodiments, it will be obvious for a person skilled in the art to practice the embodiments herein with modifications.

ADVANTAGES OF THE INVENTION

The embodiments of hie present invention provide a reconfigurable multi-band filtenna using a plurality of simple microstrip resonators which can be designed to desired frequency by varying the physical length of each resonator embedded within a microstrip filter.

The embodiments ofthe present invention provide independent switching between desired frequency bands by using simple actuators and simple biasing circuitry.

The embodiments of the present invention provide an operating frequency can be altered as per users' demand and hence is highly suited for cognitive radio applications.

The embodiments of the present invention provide a filtenna that uses simple techniques incorporating PIN diodes for achieving frequency agility between four application bands unlike existing techniques that use complex FSS and SIW techniques.

The embodiments of the present invention facilitate good spectrum efficiency and frequency selectivity without increasing the receiver complexity.

The embodiments of the present invention provide a filtenna that integrates the filter at the feed of the antenna to suppress the interference without affecting the radiating part of the filtenna, which improves the receiver sensitivity without affecting the radiation properties of the antenna system.

The embodiments of the present invention achieves lower resonance at 1.8 GHz using compact sized filtenna. Further the filtenna is cost-effective by virtue of being fabricated on a low cost dielectric.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments.

It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the embodiments herein with modifications. Although the embodiments herein are described with various specific embodiments, it will be obvious for a person skilled in the art to practice the embodiments herein with modifications.

We claim:

1. A multiband reconfigurable filtenna comprising:

an monopole antenna coupled to a center split tyransmission line;

a reconfigurable mircrostrip filter replacing a feed-in end of the center split transmission line to provide resonance at a plurality of frequency bands, the reconfigurable microstrip filter comprising:

a C-shaped resonator (CSR) coupled at a first predefined position to the center split transmission line and configured to provide a resonance to the monopole antenna at a first frequency band;

a meandered loop resonator (MLR) coupled at a second predefined position to the center split transmission line and configured to provide a resonance to the monopole antenna at a second frequency band;

an Inverted Pulse Shaped Resonator (IPSR) coupled at a third predefined position to the center split transmission line and configured to provide a resonance to the monopoie antenna at a third frequency band; and an Open Circuited Stub (OCS) coupled at a fourth predefined position to the center split transmission line and configured to provide a resonance to the monopoly antenna at a fourth frequency band; and a plurality of switches coupled to the reconfigurable microstrip filter configured to switch coupling of the monopole antenna between the CSR, the MLR, the IPSR and the OCS for operating the monopole antenna at one of the first frequency band, the second frequency band, the third frequency band and the fourth frequency band respectively.

2. The multiband reconfigurable filtenna of claim 1, further comprising:

a bandstop filter coupled to the reconfigurable microstrip to provide interference cancellation between fee plurality of frequency bands.

3. The multiband reconfigurable filtenna of claim 1, wherein the first frequency band is based on a physical length of the CSR, and wherein the physical length of the CSR is alterable.

4. The multiband reconfigurable filtenna of claim 1, wherein the second frequency band is based on a circumferential length of a loop comprising the MLR, and wherein the circumferential length of the loop is alterable.

5. The multiband reconfigurable filtenna of claim 1, wherein the third frequency band is based on a physical length of the IPSR, and wherein the physical length of the IPSR is alterable.

6. The multiband reconfigurable filtenna of claim 1, wherein the fourth frequency band is based on a physical length of the OCS, and wherein the physical length of the OCS is alterable.

7. The multiband reconfigurable filtenna of claim 1, wherein the first frequency band is a Global System for Mobile Communications (GSM) band of 1.8 Gigahertz, the second frequency band is a Worldwide Interoperability for Microwave Access (WiMax) frequency band of 3.5 Gigahertz, the third frequency band is a Bluetooth frequency band of 2.4 Gigahertz and the fourth frequency band is a Wireless Local Area Network (WLAN) frequency band of 5.2 Gigahertz.

8. The multiband reconfigurable filtenna of claim 1, wherein the first predefined position comprises a lateral side of the center split transmission line, the second predefined position comprises an area enclosed by the CSR, the third predefined position comprises another lateral side symmetrically opposite to the lateral side of the center split transmission line, and the fourth predefined position comprises an area enclosed by the IPSR.

9. The multiband reconfigurable filtenna of claim 1, wherein the plurality of switches comprises a plurality of PIN diodes operated to be at least one of open and short based on control signals provided by a biasing circuit, and couple or decouple one of CSR, MLR, IPSR and OCS to the monopole antenna respectively.

10. The multiband reconfigurable filtenna of claim 1, wherein the feed-in end of the center split transmission line replaced by the reconfigurable microstrip filter bears a resistance of fifty ohms.

11. The multiband reconfigurable filtenna of claim 1, wherein, center split transmission line is an electrical transmission line split at the center configured to carry electrical signals to the monopole antenna.

12. The multiband reconfigurable filtenna of claim 1, further comprising:

a perturbed rectangular slot, etched in a ground of the reconfigurable microstrip filter, configured to increase a bandwidth of the plurality of frequency bands.

* * * * *